United States Patent [19]

Dyal

[11] 4,031,626

[45] June 28, 1977

[54] METHOD FOR DRAFTING GARMENT PATTERNS AND MEANS FOR PRACTICING SAME

[76] Inventor: Marjorie M. Dyal, 1934 S. Kenilworth, Berwyn, Ill. 60402

[22] Filed: Feb. 20, 1975

[21] Appl. No.: 551,268

[52] U.S. Cl. ..... 33/17 R

[51] Int. Cl.[2] ..... A41H 3/06

[58] Field of Search ..... 33/17 R, 17 A, 11, 12

[56] References Cited

FOREIGN PATENTS OR APPLICATIONS

| | | | |
|---|---|---|---|
| 970,687 | 6/1950 | France | 33/17 R |
| 366,906 | 8/1930 | United Kingdom | 33/17 R |

*Primary Examiner*—Harry N. Haroian
*Assistant Examiner*—Willis Little
*Attorney, Agent, or Firm*—Silverman & Cass, Ltd.

[57] ABSTRACT

A method for garment pattern drafting for developing proportioned or graded slopers employing a grid or graphical display based upon quarter-inch spaces and comprising a series of parallel vertical and horizontal intersecting lines, the vertical series being equispaced a number of quarter-inch spaces and sixteenth-inch fractions thereof expressed as the quotient resulting from quartering the larger of actual measurements taken around the human figure, and the horizontal series being equispaced a number of quarter-inch spaces and sixteenth-inch fractions thereof expressed as the sum of the quotient of the actual centerfront measurement taken from the same figure plus a factor of two quarter-inch spaces. Suitable mounting means for the grid as well as rule members carrying a scale for marking off distances in terms of said quarter spaces are provided for constructing the grid. Also, a scale carrying curve tracer tool capable of finding its own pivot point is provided for developing the required curvilinear lines of the pattern.

7 Claims, 11 Drawing Figures

FIG. 2A
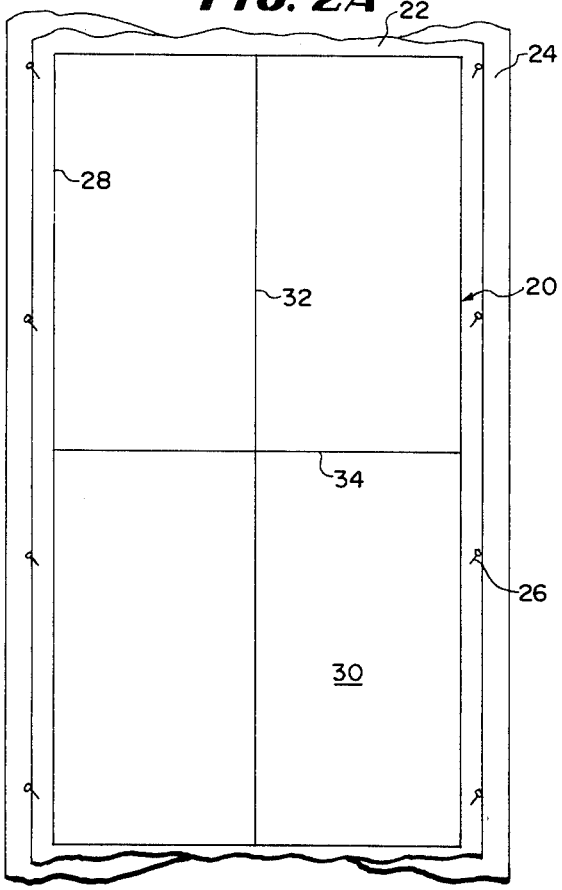
FIG. 2B
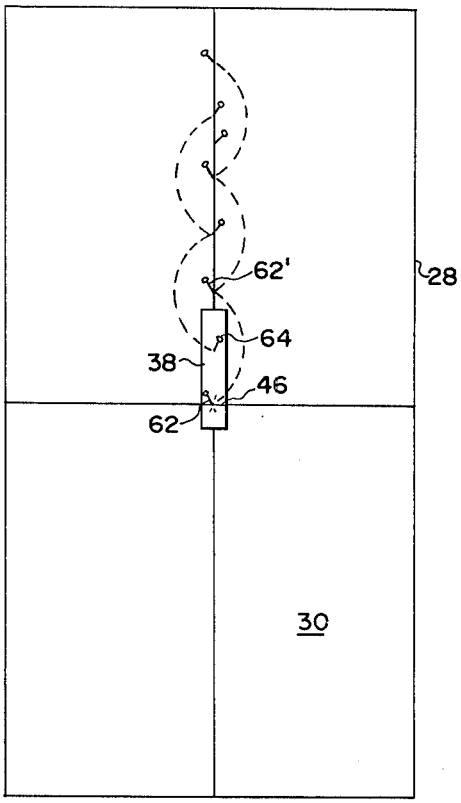
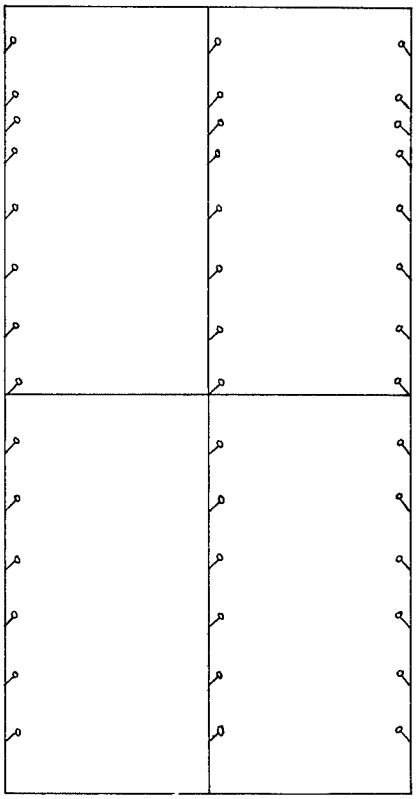
FIG. 2C
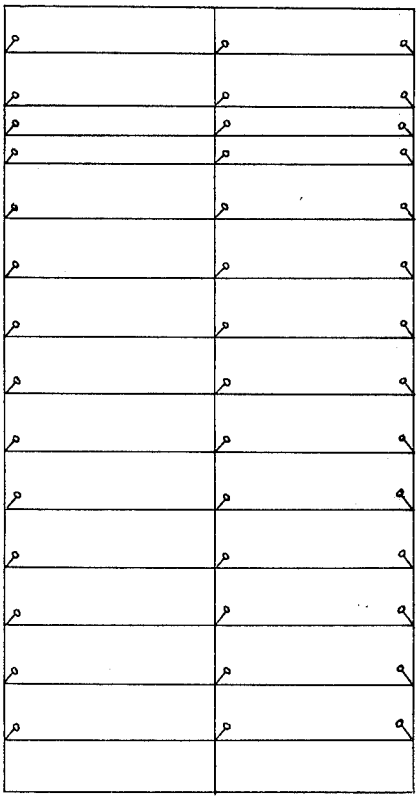
FIG. 2D

METHOD FOR DRAFTING GARMENT PATTERNS AND MEANS FOR PRACTICING SAME

This invention relates generally to garment pattern drafting and more particularly provides an improved method for drafting a correctly proportioned or graded basic garment pattern and also provides means for efficiently practicing said method.

The drafting or layout of garment patterns has long been an art involving the utilization of substantial skills the acquisition of which requires much training and experience. Considerable difficulty has been encountered by the layman or untrained operator in constructing garment patterns. The primary pattern, that is the basic garment pattern which is cut to standard size from a table of standard body measurements, is referred to commonly as a "sloper." The sloper contains all the necessary information about the shaping, contour and ease that will enable the represented garment component to fit a particular size. The sloper itself has no fullness, design details or seam allowances and is used for the creation of new designs. Many garment manufacturers, as well as commercial vendors of garment patterns gain reputation and appeals on a particular cut and fit for what they consider a standard size. However, it will be found that each of the so-called standard sizes are different in some respects. If the standard size selected suits a particular individual, no problem is encountered in translating the pattern to a finished garment with resultant proper fit and proportionality. As can be understood, very few individuals fit into such "standardized" category. Accordingly, either the particular individual shops about in a "trial and error" method and searches the commercial pattern ranks for a so-called standard which is personally satisfactory, or such individual must adjust the one located which is closest to satisfactory, to suit. Often, in addition to the complexities involved, it is likely that the results obtained in such adjustment will prove unsatisfactory and the garment will have to be fitted after cutting from the adjusted pattern. Also, each pattern or group of patterns must be individually adjusted with no universal reference available for other garment pattern adjustments for an individual. Great danger lies in possible loss of proportionality as adjustments are made.

Even after the selection of a so-called "standard" size pattern which ostensibly suits, the operator must adjust the standard which is of one size, to the individual's size, should it differ . . . which it undoubtedly will. This process involves complex proportionality calculations, estimates and derivations which tend to confuse and render pattern drafting an art capable of being practiced by few.

Design details are difficult to introduce into the "sloper" once the same has been adjusted to proportion and size. Therefore, design details are introduced to the standard and proportional changes for size, etc., are made later. If a garment is cut from such a pattern, much skill and adjustment is required in the course of sewing same. Material is wasted. Occasionally, the parts of the pattern may be too small properly to join or mate with the other component sections requiring redrafting of the pattern.

The drafting of proportioned slopers, that is graded slopers, has been difficult. The advantage in using graded pattern portions is that designs developed therefrom utilize the individual's actual measurements and hence the garment components resulting from use of such patterns will combine correctly to provide a properly proportioned finished garment and with the minimum waste of both time and material.

Another difficulty encountered in the use of present pattern development methods resides in the compilation and publication of information concerning design details and instructions by the pattern maker for incorporation of design details into a prepared sloper. Generally this involves direct measurements, difficult drafting techniques, use of compasses, precise, sometimes minaturized measurements and layout techniques, etc., these steps being difficult for a layman to follow and to perform.

Accordingly, in addition to the long felt need for a simplified method of drafting or laying out properly proportioned slopers or basic garment patterns, a similar need arises for development of a language for communicating instructions concerning incorporation of design details to a prepared sloper. Printed instructions are desired which can be interpreted and transcribed by the layman and applied by a layman to a graded sloper without undue hardship, complexity or dependency upon long acquired experience and skill. This enables the publication of these design details in simplified form so that the layman, having been enabled to construct the graded sloper can readily follow these printed instructions using the method of the invention, to incorporate same into the sloper to enable for construction of the designed garment pattern.

The construction of the graded sloper also requires tracing of curves in order to define the neck openings and the arm-scye as well as to construct the sleeve pattern. One difficulty in such construction is the location of the pivot point for construction of these curves. Heretofore, the well known compass has been the principal tool utilized in such curve tracing. Discovery and location of the proper pivot locations for developing a curve joining two specific locations on the sloper to form parts thereof is tedious and subject to much error. In view of that, there is provided herein, in addition to the drafting method, a curve tracing tool or device which carries information coded to the method of the invention and is transcribable easily in the course of practice of such inventive method and, as well, which is capable of self locating the proper pivot point to enable the proper curvilinear connection between two points to be constructed.

The invention contemplates the provision of a kit containing all the materials necessary to practice the method of the invention, this kit including a master board onto which can be secured sheet material for application thereupon of a graphical display constructed in accordance with the method of the invention. Rules are provided to enable conversion of the tabular length and width dimensions into distances for constructing the graphical display. A curve tracer device is provided for lying out curvilinear connections as demanded in the practice of the layout method of the invention, to enable the construction of a graded sloper and the incorporation therein of design information following the method of the invention.

BRIEF DESCRIPTION OF THE DRAWINGS

FIG. 2A represents the first step in constructing the graphical display according to the method of the invention;

FIG. 2B represents a further development of subject graphical display;

FIG. 2C represents a still further step in the development of the subject graphical display;

FIGS. 2D and 2E represents further steps in the development of the subject graphical display;

DESCRIPTION OF THE PREFERRED EMBODIMENT

Basic to the method of the invention is the preparation of a proportioned graphical display hereinafter referred to as a grid. The grid is applied to a flexible sheet material, such as cloth, which has been mounted to a relatively rigid board. Pins, markers and the like can be inserted through the cloth into the board to secure same thereupon. The grid is developed to measurements taken from a particular individual and is used to plot, that is, to lay out all sections of the basic pattern. The basic pattern components are termed slopers.

The human figure is proportioned to enable a garment pattern to be laid out in quarter sections, and can be divided on a scale of 16 parts around the figure. The human figure is capable of standardized proportioning in respect of a measurement representing the height of the individual as the length dimension of the garment. The said length dimension also is proportionable on a 16 unit scale. Fourteen and one-half units of the scale are taken along a plumb line extending from the base of the neck at the collar bone to the floor, this being the center front length measurement. One and one-half units along the scale mark the difference between a measurement taken from the nape of the neck to the floor and the center front measurement.

It has been found that the proportionality along the length can be marked as four and one-half units above the waist and six units on the scale below the waist, 10 units from waist to floor, seven units from hip to floor, and three units from waist to hip, the invention involves the plotting of the grid and utilization thereof based upon the aforesaid proportionality.

Figure 1A:
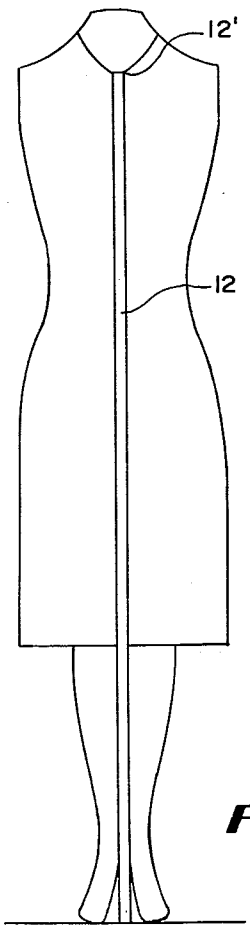
FIGS. 1 and 1A are diagrammatic side and front representations of a human female figure illustrating the location of actual figure measurements required for practice of the method of the invention enabling the construction of a graded sloper.
Figure 1:
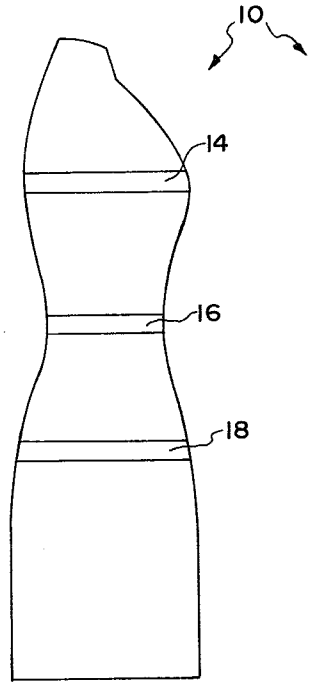

Referring to the drawings, in FIGS. 1 and 1A the human figure is represented by reference character 10. The four basic measurements which are to be taken from an individual for the construction of the grid according to the invention are represented by the illustrated tapes. Tape 12 represents the length measurement taken from the base of the neck at the top 12′ of the sternum to the floor. Tape 14 represents the chest or bust measurement. Tape 16 represents the waist measurement and tape 18 represents the hip measurement.

After the measurements represented by reference characters 12, 14, 16 and 18 are taken and recorded, the grid specific to that individual is constructed. The grid is represented generally by reference character 20 in FIG. 2 as a completed graphical display, shown in various stages of development in FIGS. 2A through 2D. The first step in construction of the grid 20 is the cutting and placement of a sheet 22 of flexible cloth material upon a rigid board 24. Board 24 preferably is formed of corrugated paperboard, cork, or the like which is capable of receiving and retaining fastening means such as thumbtacks, pins, and the like represented by reference character 26. The sheet 22 preferably is capable of being inscribed by marking means such as a pencil, pen and the like and is surface treated so that inscriptions thereon are retained without blotting, smearing, etc.

After sheet 22 has been fastened to board 24, four equal rectangular quarters are inscribed thereupon. A large rectangular representation 28 is first applied and then is divided into equal quarter sections 30 by application of a vertical line 32 and a horizontal line 34. Vertical line 32 defining what can represent the Y axis of the grid 20 and vertical line 34 represents the X axis of grid 20.

A pair of straight edge rules 36 and 38 are provided. These are illustrated in FIG. 4. Each rule 36 and 38 is flat, elongate and has a scale along its length formed of quarter-inch graduations across its width. Also, each of the rules 36 and 38 have a row of perforations 40, 42 respectively, intersected by the lines marking off the scale graduations. The perforations 40, 42 have a diameter sufficient to accommodate a pencil point or other scribing tip for marking off the grid lines and to enable 180° pivoting of the rule in the course of constructing the grid. The graduations on each rule 36 and 38 marked off from a base line 44, 46 respectively located one-quarter inch from one end 48, 50 respectively of each rule 36 and 38. The quarter inch distance space between said ennds 48, 50 and the respective base lines 44, 46 are marked off in subscales 52, 54 consisting of four equal spaces, each measuring one-sixteenth of an inch.

According to the method of the invention, one of the rules, here rule 36, is marked off in terms of a width scale while the other, rule 38 is marked off in terms of a length scale. The length scale is utilized for the plotting of graduations along the Y axis. The width scale is utilized in the construction of the graduations along the X axis.

Each scale is marked off with indicia inscribed upon the respective rules 36 and 38 and is determined by division of the actual measurement, say of width (around the figure) and length taken from the individual by a factor of four. This calculation shall be referred to as quartering.

In respect of the length rule 38, the indicia applied thereto is the result of quartering of the actual measurement represented by tape 12 in FIG. 1A and the addition to the resulting quotient of a factor to compensate for the normally expected difference between the measurement taken from the nape or back of the neck to the floor and that taken from the base of the neck (front) to the floor. This factor has been found empirically to be two quarter-inch units. In the preferred mode of practicing the invention, the scale indicia for the length rule 38 are calculated and the operator is provided with a tabular representation as set forth below.

VERTICAL MEASURES

NOTE: Columns 1 to 8 are quarter-space measurements. The C.F.L. measurements are in inches.

| C.F.L. (iches) | 1 | 2 | 3 | 4 | 5 | 6 | 7 | 8 |
|---|---|---|---|---|---|---|---|---|
| 24 | 8/ | 16/ | 24/ | 32/ | 40/ | 48/ | 56/ | 64/ |
| 25 | 8/1 | 16/2 | 24/3 | 33/ | 41/1 | 49/2 | 57/3 | 66/ |
| 26 | 8/2 | 17/ | 25/2 | 34/ | 42/2 | 51/ | 59/2 | 68/ |
| 27 | 8/3 | 17/2 | 26/1 | 35/ | 43/3 | 52/2 | 61/1 | 70/ |
| 28 | 9/ | 18/ | 27/ | 36/ | 45/ | 54/ | 63/ | 72/ |
| 29 | 9/1 | 18/2 | 27/3 | 37/ | 46/1 | 55/2 | 64/3 | 74/ |
| 30 | 9/2 | 19/ | 28/2 | 38/ | 47/2 | 57/ | 66/2 | 76/ |
| 31 | 9/3 | 19/2 | 29/1 | 39/ | 48/3 | 58/2 | 68/1 | 78/ |
| 32 | 10/ | 20/ | 30/ | 40/ | 50/ | 60/ | 70/ | 80/ |
| 33 | 10/1 | 20/2 | 30/3 | 41/ | 51/1 | 61/2 | 71/3 | 82/ |
| 34 | 10/2 | 21/ | 31/2 | 42/ | 52/2 | 63/ | 73/2 | 84/ |
| 35 | 10/3 | 21/2 | 32/1 | 43/ | 53/3 | 64/ | 75/1 | 86/ |
| 36 | 11/ | 22/ | 33/ | 44/ | 55/ | 66/ | 77/ | 88/ |
| 37 | 11/1 | 22/2 | 33/3 | 45/ | 56/1 | 67/2 | 78/3 | 90/ |
| 38 | 11/2 | 23/ | 34/2 | 46/ | 57/2 | 69/ | 80/2 | 92/ |
| 39 | 11/3 | 23/2 | 35/1 | 47/ | 58/3 | 70/2 | 82/1 | 94/ |
| 40 | 12/ | 24/ | 36/ | 48/ | 60/ | 72/ | 84/ | 96/ |
| 41 | 12/1 | 24/2 | 36/3 | 49/ | 61/1 | 73/2 | 85/3 | 98/ |
| 42 | 12/2 | 25/ | 37/2 | 50/ | 62/2 | 75/ | 87/2 | 100/ |
| 43 | 12/3 | 25/2 | 38/1 | 51/ | 63/3 | 76/2 | 89/1 | 102/ |
| 44 | 13/ | 26/ | 39/ | 52/ | 65/ | 78/ | 91/ | 104/ |
| 45 | 13/1 | 26/2 | 39/3 | 53/ | 66/1 | 79/2 | 92/3 | 106/ |
| 46 | 13/2 | 27/ | 40/2 | 54/ | 67/2 | 81/ | 94/2 | 108/ |
| 47 | 13/3 | 27/2 | 41/1 | 55/ | 68/3 | 82/2 | 96/1 | 110/ |
| 48 | 14/ | 28/ | 42/ | 56/ | 70/ | 84/ | 98/ | 112/ |
| 49 | 14/1 | 28/2 | 42/3 | 57/ | 71/1 | 85/2 | 99/3 | 114/ |
| 50 | 14/2 | 29/ | 43/2 | 58/ | 72/2 | 87/ | 101/2 | 116/ |
| 51 | 14/3 | 29/2 | 44/1 | 59/ | 73/3 | 88/2 | 103/1 | 118/ |
| 52 | 15/ | 30/ | 45/ | 60/ | 75/ | 90/ | 105/ | 120/ |
| 53 | 15/1 | 30/2 | 45/3 | 61/ | 76/1 | 91/2 | 106/3 | 122/ |
| 54 | 15/2 | 31/ | 46/2 | 62/ | 77/2 | 93/ | 108/2 | 124/ |
| 55 | 15/3 | 31/2 | 47/1 | 63/ | 78/3 | 94/2 | 110/1 | 126/ |
| 56 | 16/ | 32/ | 48/ | 64/ | 80/ | 96/ | 112/ | 128/ |
| 57 | 16/1 | 32/2 | 48/3 | 65/ | 81/1 | 97/2 | 113/3 | 130/ |
| 58 | 16/2 | 33/ | 49/2 | 66/ | 82/2 | 99/ | 115/2 | 132/ |
| 59 | 16/3 | 33/2 | 50/1 | 67/ | 83/3 | 100/2 | 117/1 | 134/ |
| 60 | 17/ | 34/ | 51/ | 68/ | 85/ | 102/ | 119/ | 136/ |
| 61 | 17/1 | 34/2 | 51/3 | 69/ | 86/1 | 103/2 | 120/3 | 138/ |
| 62 | 17/2 | 35/ | 52/2 | 70/ | 87/2 | 105/ | 122/2 | 140/ |
| 63 | 17/3 | 35/2 | 53/1 | 71/ | 88/3 | 106/2 | 124/1 | 142/ |
| 64 | 18/ | 36/ | 54/ | 72/ | 90/ | 108/ | 126/ | 144/ |
| 65 | 18/1 | 36/2 | 54/3 | 73/ | 91/1 | 109/2 | 127/3 | 146/ |
| 66 | 18/2 | 37/ | 55/2 | 74/ | 92/2 | 111/ | 129/2 | 148/ |
| 67 | 18/3 | 37/2 | 56/1 | 75/ | 93/3 | 112/2 | 131/1 | 150/ |
| 68 | 19/ | 38/ | 57/ | 76/ | 95/ | 114/ | 133/ | 152/ |
| 69 | 19/1 | 38/2 | 57/3 | 77/ | 96/1 | 115/2 | 134/3 | 154/ |
| 70 | 19/2 | 39 | 58/2 | 78/ | 97/2 | 117/ | 136/2 | 156/ |
| 71 | 19/3 | 39/2 | 59/1 | 79/ | 98/3 | 118/2 | 138/1 | 158/ |
| 72 | 20/ | 40/ | 60/ | 80/ | 100/ | 120/ | 140/ | 160/ |
| 73 | 20/1 | 40/2 | 60/3 | 81/ | 101/1 | 121/2 | 141/3 | 162/ |
| 74 | 20/2 | 41/ | 61/2 | 82/ | 102/2 | 123/ | 143/2 | 164/ |
| 75 | 20/3 | 41/2 | 62/1 | 83/ | 103/3 | 124/2 | 145/1 | 166/ |
| 76 | 21/ | 42/ | 63/ | 84/ | 105/ | 126/ | 147/ | 168/ |

| C.F.L. (inches) | 9 | 10 |
|---|---|---|
| 24 | 72/ | 80/ |
| 25 | 74/1 | 82/2 |
| 26 | 76/2 | 85 |
| 27 | 78/3 | 87/2 |
| 28 | 81/ | 90/ |
| 29 | 82/1 | 92/2 |
| 30 | 85/2 | 95 |
| 31 | 87/3 | 97/2 |
| 32 | 90/ | 100/ |
| 33 | 92/1 | 102/2 |
| 34 | 94/2 | 105 |
| 35 | 96/3 | 107/2 |

-continued

VERTICAL MEASURES
NOTE: Columns 1 to 8 are quarter-space measurements.
The C.F.L. measurements are in inches.

| | | |
|---|---|---|
| 36 | 99/ | 110/ |
| 37 | 101/1 | 112/2 |
| 38 | 103/2 | 115/ |
| 39 | 105/3 | 117/2 |
| 40 | 108/ | 120/ |
| 41 | 110/1 | 122/2 |
| 42 | 112/2 | 125/ |
| 43 | 114/3 | 127/2 |
| 44 | 117/ | 130/ |
| 45 | 119/1 | 132/2 |
| 46 | 121/2 | 135/ |
| 47 | 123/3 | 137/2 |
| 48 | 126/ | 140/ |
| 49 | 128/1 | 142/2 |
| 50 | 130/2 | 145/ |
| 51 | 132/3 | 147/2 |
| 52 | 135/ | 150/ |
| 53 | 137/1 | 152/2 |
| 54 | 139/2 | 155 |
| 55 | 141/3 | 157/2 |
| 56 | 144/ | 160/ |
| 57 | 146/1 | 162/2 |
| 58 | 148/2 | 165/ |
| 59 | 150/3 | 167/2 |
| 60 | 153/ | 170/ |
| 61 | 155/1 | 172/2 |
| 62 | 157/2 | 175/ |
| 63 | 159/3 | 177/2 |
| 64 | 162/ | 180/ |
| 65 | 164/1 | 182/2 |
| 66 | 166/2 | 185/ |
| 67 | 168/3 | 187/2 |
| 68 | 171/ | 190/ |
| 69 | 173/1 | 192/2 |
| 70 | 175/2 | 195 |
| 71 | 177/3 | 197/2 |
| 72 | 180/ | 200/ |
| 73 | 182/1 | 202/2 |
| 74 | 184/2 | 205 |
| 75 | 186/3 | 207/2 |
| 76 | 189/ | 210/ |

The scale for rule 38 is inscribed on rule 38 and marked off in whole numbers found in the tubular representation, so that the length rule 38 becomes a master length rule. For fractional quotients, the operator merely steps off selected spaces of the subscale 54 and uses the graduation as the base line graduation and the closest whole number graduation in constructing grid 20. The indicia represented on the rule 38 comprise the numeral representing the actual measurements but the graduations that are the number of spaces along the scale at which the numerals appear are selected by reference to the tabular representation and represent the quarter space allotments for the measurements. Thus an actual length measurement of 56 inches would be represented by numeral "56" applied to the rule 38 with the number of units or spaces from the base line 46 being 16 whole spaces to the location 58 when the numeral 56 is inscribed. Using the rule 38 where the actual measurement is "57 " inches, for example, the quartering quotient is equivalent to the number of units at which numeral 56 is located plus one unit on the subscale 54 representing a fraction equal to one-sixteenth inch. As will be explained hereinafter, the construction of grid 20 where a 57 inch length measurement is involved would necessitate use of the closest whole number, here 56, on the scale of Rule 38 and one fractional graduation on the subscale 54 as the base line instead of base line 46.

The width rule 36 is constructed and a scale applied representing actual width measurements, that is the measurements taken around the individual's figure. For rule 36, the actual measurement is quartered with no factor being added. A tabular representation similar to that used for the length scale development is calculated and appears as follows:

HORIZONTAL MEASURES

| BUST: WAIST: HIP: UNDERBUST: | 1 BLOCK WIDTH | | 2 BLOCK WIDTH | | 3 BLOCK WIDTH | | 4 BLOCK WIDTH | |
|---|---|---|---|---|---|---|---|---|
| 20 | 1 | 4/16 | 2 | 8/16 | 3 | 12/16 | 5 | |
| 21 | 1 | 5/16 | 2 | 10/16 | 3 | 15/16 | 5 | 4/16 |
| 22 | 1 | 6/16 | 2 | 12/16 | 4 | 2/16 | 5 | 8/16 |
| 23 | 1 | 7/16 | 2 | 14/16 | 4 | 5/16 | 5 | 12/16 |
| 24 | 1 | 8/16 | 3 | | 4 | 8/16 | 6 | |
| 25 | 1 | 9/16 | 3 | 2/16 | 4 | 11/16 | 6 | 4/16 |
| 26 | 1 | 10/16 | 3 | 4/16 | 4 | 14/16 | 6 | 8/16 |
| 27 | 1 | 11/16 | 3 | 6/16 | 5 | 1/16 | 6 | 12/16 |
| 28 | 1 | 12/16 | 3 | 8/16 | 5 | 4/16 | 7 | |
| 29 | 1 | 13/16 | 3 | 10/16 | 5 | 7/16 | 7 | 4/16 |
| 30 | 1 | 14/16 | 3 | 12/16 | 5 | 10/16 | 7 | 8/16 |
| 31 | 1 | 15/16 | 3 | 14/16 | 5 | 13/16 | 7 | 12/16 |
| 32 | 2 | | 4 | | 6 | | 8 | |
| 33 | 2 | 1/16 | 4 | 2/16 | 6 | 3/16 | 8 | 4/16 |

-continued

| BUST: WAIST: HIP: UNDERBUST: | HORIZONTAL MEASURES 1 BLOCK WIDTH | | 2 BLOCK WIDTH | | 3 BLOCK WIDTH | | 4 BLOCK WIDTH | |
|---|---|---|---|---|---|---|---|---|
| 34 | 2 | 2/16 | 4 | 4/16 | 6 | 6/16 | 8 | 8/16 |
| 35 | 2 | 3/16 | 4 | 6/16 | 6 | 9/16 | 8 | 12/16 |
| 36 | 2 | 4/16 | 4 | 8/16 | 6 | 12/16 | 9 | |
| 37 | 2 | 5/16 | 4 | 10/16 | 6 | 15/16 | 9 | 4/16 |
| 38 | 2 | 6/16 | 4 | 12/16 | 7 | 2/16 | 9 | 8/16 |
| 39 | 2 | 7/16 | 4 | 14/16 | 7 | 5/16 | 9 | 12/16 |
| 40 | 2 | 8/16 | 5 | | 7 | 8/16 | 10 | |
| 41 | 2 | 9/16 | 5 | 2/16 | 7 | 11/16 | 10 | 4/16 |
| 42 | 2 | 10/16 | 5 | 4/16 | 7 | 14/16 | 10 | 8/16 |
| 43 | 2 | 11/16 | 5 | 6/16 | 8 | 1/16 | 10 | 12/16 |
| 44 | 2 | 12/16 | 5 | 8/16 | 8 | 4/16 | 11 | |
| 45 | 2 | 13/16 | 5 | 10/16 | 8 | 7/16 | 11 | 4/16 |
| 46 | 2 | 14/16 | 5 | 12/16 | 8 | 10/16 | 11 | 8/16 |
| 47 | 2 | 15/16 | 5 | 14/16 | 8 | 13/16 | 11 | 12/16 |
| 48 | 3 | | 6 | | 9 | | 12 | |
| 49 | 3 | 1/16 | 6 | 2/16 | 9 | 3/16 | 12 | 4/16 |
| 50 | 3 | 2/16 | 6 | 4/16 | 9 | 6/16 | 12 | 8/16 |
| 51 | 3 | 3/16 | 6 | 6/16 | 9 | 9/16 | 12 | 12/16 |
| 52 | 3 | 4/16 | 6 | 8/16 | 9 | 12/16 | 13 | |
| 53 | 3 | 5/16 | 6 | 10/16 | 9 | 15/16 | 13 | 4/16 |
| 54 | 3 | 6/16 | 6 | 12/16 | 10 | 2/16 | 13 | 8/16 |
| 55 | 3 | 7/16 | 6 | 14/16 | 10 | 5/16 | 13 | 12/16 |
| 56 | 3 | 8/16 | 7 | | 10 | 8/16 | 14 | |
| 57 | 3 | 9/16 | 7 | 2/16 | 10 | 11/16 | 14 | 4/16 |
| 58 | 3 | 10/16 | 7 | 4/16 | 10 | 14/16 | 14 | 8/16 |
| 59 | 3 | 11/16 | 7 | 6/16 | 11 | 1/16 | 14 | 12/16 |
| 60 | 3 | 12/16 | 7 | 8/16 | 11 | 4/16 | 15 | |

The indicia applied to the rule 36 is formed as the representative whole number ones of the width measurements set forth in the above table, that is measurements whose quartering results in whole members rather than fractions of quarter spaces. The scale is marked off beginning with base line 44. Indicia numeral "36" on the scale represents a 36 inch measurement quartered to a quotient of nine and is located nine spaces from the base line 44 at location 60. A subscale 52 is applied to rule 36 similar to subscale 54 of rule 38. The subscale 52 consists of three cross-lines dividing the quarter inch space from end 48 to the base line 44 into four sixteenth-inch spaces.

Thus, in both rules 36 and 38 no graduations are present which are less than one-sixteenth inch. In the course of constructing the grid and the slopers therefrom using rules 36 and 38, the operator is not concerned with any actual layout dimensions less than one-sixteenth inch.

Reference is made to respective tabular representations for all those indicia of the scales of the respective rules to provide the whole space numerals.

Using rules 36 and 38 which are prescribed and provided preferably as a component of a pattern layout kit, the grid 20 is ready to be drafted. One or the other of rules 36 and 38 can be utilized first. In FIG. 2B, rule 38 is selected for first employment. The base line 46 thereof, or where a fractional quotient has resulted from quartering of the actual length measurement, that line of subscale 54 which is used then as a base line, is aligned with the intersection of the X and Y axes as shown in FIG. 2B and a pin 62 inserted through the appropriate perforation. In the example, we are using a 56 inch center front measurement. The perforation on rule 38 at numeral 56 of the scale carried thereby is located and a pin 64 inserted therethrough on the Y axis. Pin 62 is removed and the rule 38 is pivoted 180° along a horizontal plane relative to the sheet 22 so that the perforation intersected by base line 46 is on the Y axis. Pin 62 is reinserted at line 46 as 62'. Pin 64 is withdrawn and the rule 38 is pivoted 180° about pin 62'. Pin 64, however, is replaced at the same location. Locations marked off in this same manner along the Y axis and pins placed thereat. The pivoting and pinning are continued along the Y axis so that at least six graduations or lengths are marked and located by upstanding pins. The same procedure is followed along the negative Y axis, that is below the X axis 34. Preferably, a location half way between the fourth and fifth graduation is scribed along the positive Y axis. Both the vertical perimetric lines defining the major rectangle 28 are scribed in like manner with like graduations also marked off with pins as shown in FIG. 2C. A straight edge (not shown) is laid adjacent the pins respectively and a series of horizontal lines is drawn parallel to the "X" axis 34, as shown in FIG. 2D.

Figure 2:
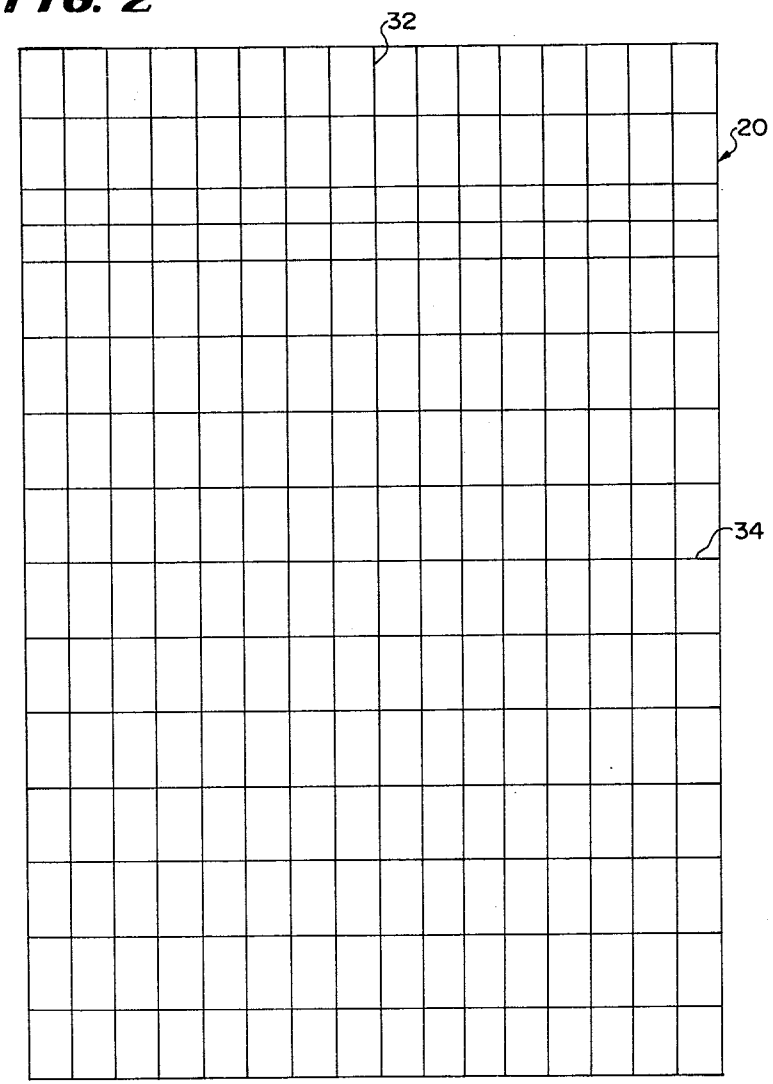
FIG. 2 represents a completed grid or graphical display constructed in accordance with the method of the invention.
Figure 2E:
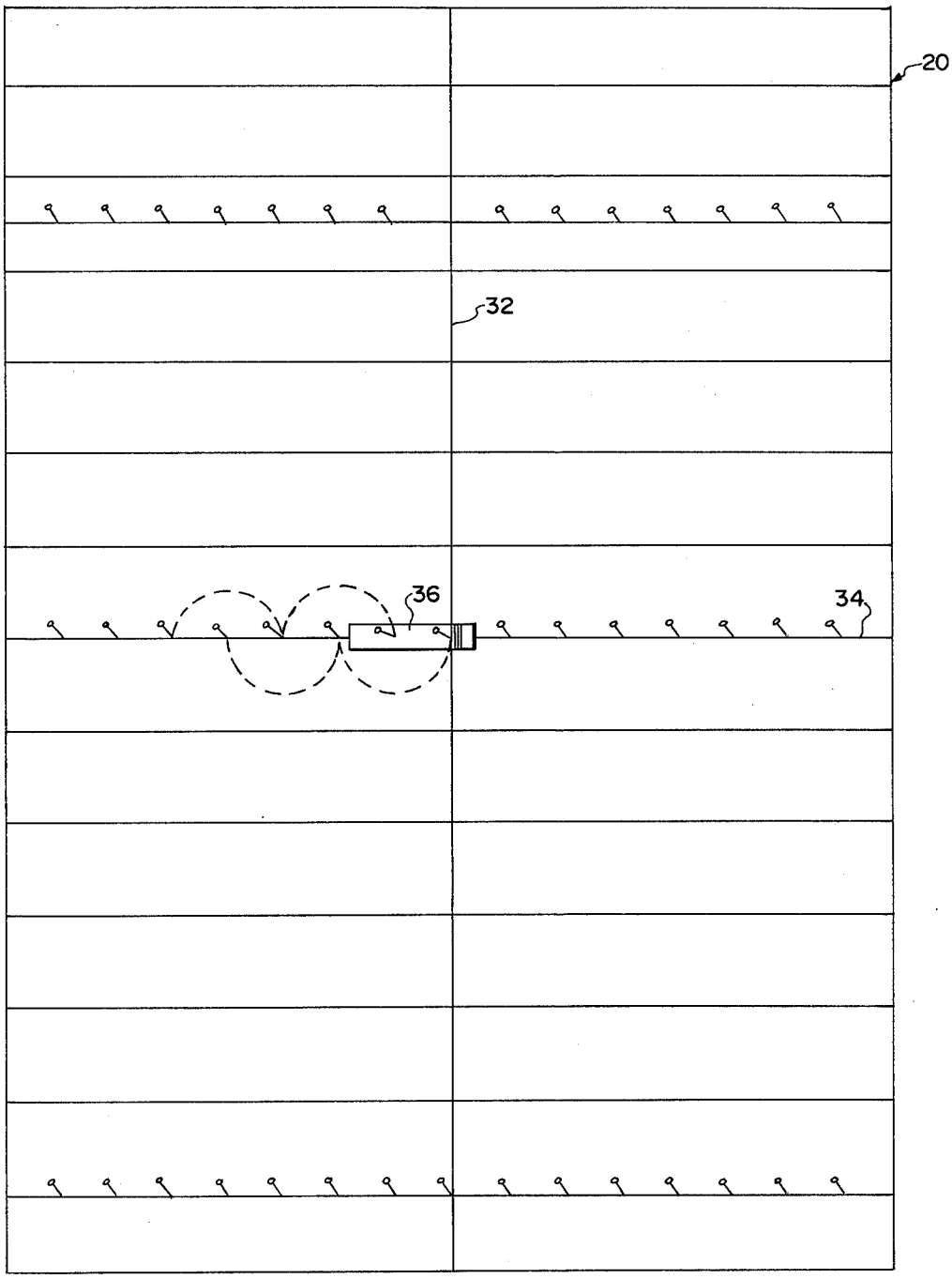
Figure 3:
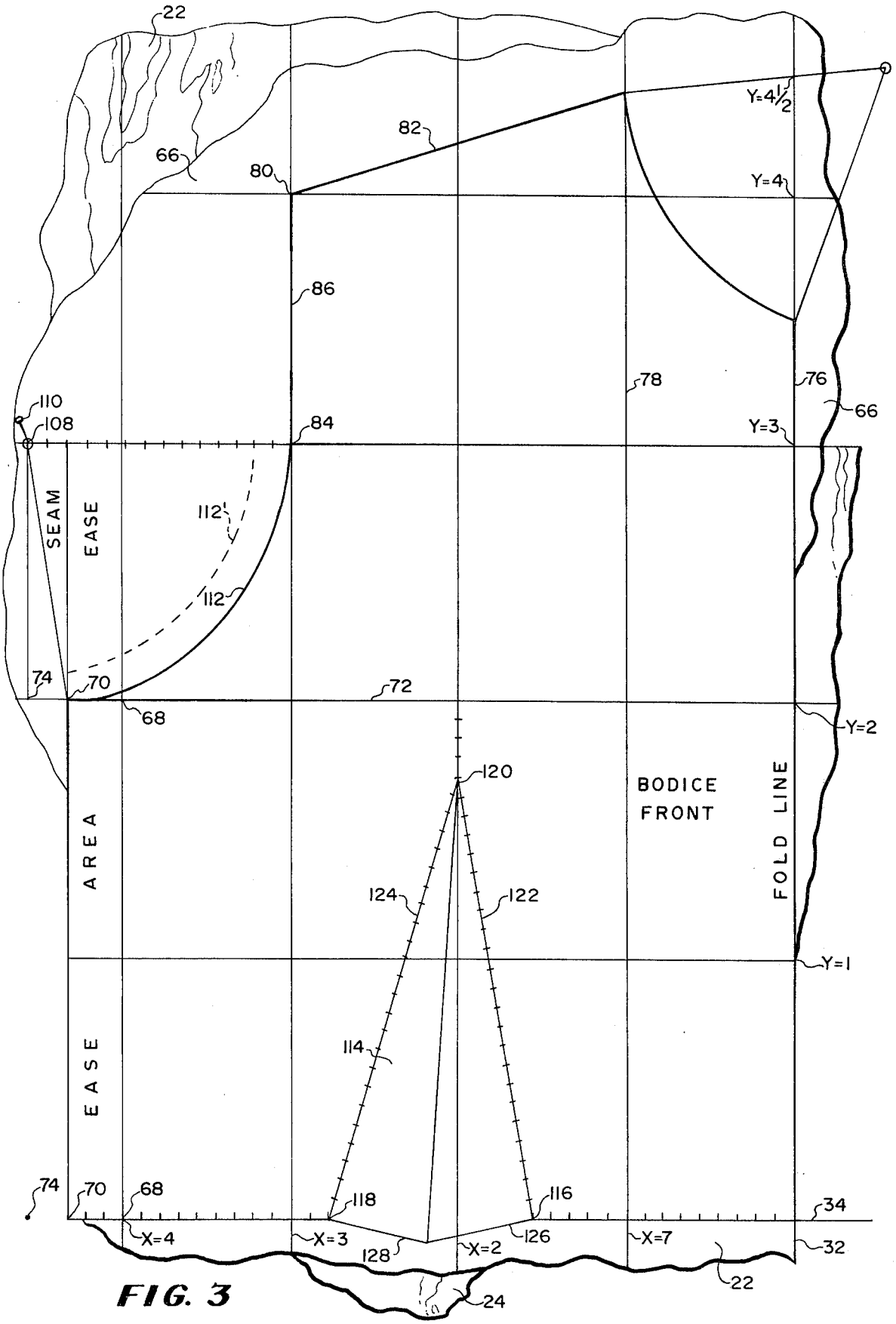
FIG. 3 represents the use of the subject graphical display in laying out a graded sloper according to the invention, the illustrated sloper capable of utilization as a right-handed bodice front quarter pattern component.

The width representative rule 36 is used on the partial grid of FIG. 2E to mark off graduations along the X axis in the identical manner used to mark off the graduations along the Y axis. Preferably at least six and no less than at least four spaces or graduations are developed on each of the positive and negative axes, marked off with pins and with a series of straight edge, a series of parallel lines scribed through the graduations along the X axis. These lines, of course, would be parallel to the Y axis as shown in FIG. 2.

The master grid 20 shown in FIG. 2 is developed on the sheet 22 specific to the particular measurements of the individual.

The grid 20 accordingly is used to lay out, that is construct, a sloper or basic pattern for any section of a garment and the resulting sloper will be graded, that is, proportioned for the particular individual concerned. The boxes, reference lines intersections and spaces of the grid are suitable for reference incorporation into clear printed instructions which are easy to follow and apply by a layman or untrained individual for incorporating design features into the drafted slopers. In addition, allowances for ease can be worked easily into the sloper as it is being laid out; reference being made to the number of rectangular units (boxes) defined by the parallel lines in any direction along the grid, as well as points of origin for departures such as location and scribing of darts, armscyes, seam allowances, etc. can be made so that these features can be developed.

In explanation of the application of the grid 20 to the drafting of a sloper, a description of the development of the right-quarter panel bodice sloper shall ensue. The sloper shall be constructed for the individual having a bust measurement of 36 inches; a waist measurement of 28 inches, a center front measurement of 56 inches, and a total height measurement of 64 inches. The sloper to be generated has allowances for ease and is based on personal measurements but no seams. The style is created on all patterns and the curves are gauged with a seam allowance of two quarter-inch spaces or units. A sheet 66 of tissue or similar thin, transluscent sheet material is fastened by tacks or similar fastener means, onto the sheet 22 on which the grid 20 has been inscribed, the sheet 22 still being secured to the board 24. Four blocks, here nine quarter spaces each, are marked off the intersection of the X and Y axes. These four blocks mark the maximum number of blocks required for a 36 inch measurement about the bust for the quarter panel being developed. A point 68 is located along the X axis, $Y = 0$. An ease area is marked off equal to three-quarter inch spaces to the left of point 68 to locate point 70 in the fifth box to the left of the Y axis. A line 72 is drawn following the line running paralling to the X axis for the four block distance, and passing through $Y=2$ and point 68. Line 72 is continued to include the left-hand extent of the ease allowance to point 70. At the extreme left of line 72, point 74 is located two quarter spaces to the left of the ease allowance. Point 74 represents the standard seam allowance. The number of allowance quarter spaces is equal to five, representing allowance for a half-inch standard seam, and three-quarters of an inch for ease. A total of 14 spaces is used at the left-end of lines 72. The point 68 on line 72 represents the maximum width measurement. Line 72 represents a distance used to develop the bust line. A line 76 is drawn, coextensive with the Y axis and extending three and one-half blocks along the Y axis is drawn and represents the fold line, no seam or ease allowance being necessary, three and one-half blocks being equivalent to 56 inches along the Y axis. A second vertical line 78 is scribed on the tissue coextensive with the $X = 1$ and the grid line thereat. The line 78 is parallel to the Y axis and extends to $Y = 4\frac{1}{2}$. Line 78 represents the maximum length from the top of the shoulder to the waist, one box length being added to the center front measurement representative line 76. A point 80 two block widths to the left of line 78 located at the grid line intersection describable as $Y = 4$, $X = 3$. A line 82 is scribed between the upper end of line 78 and point 80. This line 82 represents the shoulder line. A point 84 ($Y=3, X=3$) is located one block length below point 80 and line 86 is drawn connecting point 80 to point 84. Point 84 defines the upper limit of the proposed arms-scye.

The curvilinear lines defining the neck opening and the armscye opening are next to be developed. For that purpose, the operator must locate the pivot point at which a member carrying a tracing element must be pivoted to scribe the proper curve connecting the respective points. The method of tracing these curves shall now be described. The invention provides a simple device also graduated as a quarter-inch scale so as to enable such curvilinear lines easily and properly to be traced with reference to the grid 20.

Figure 4A:
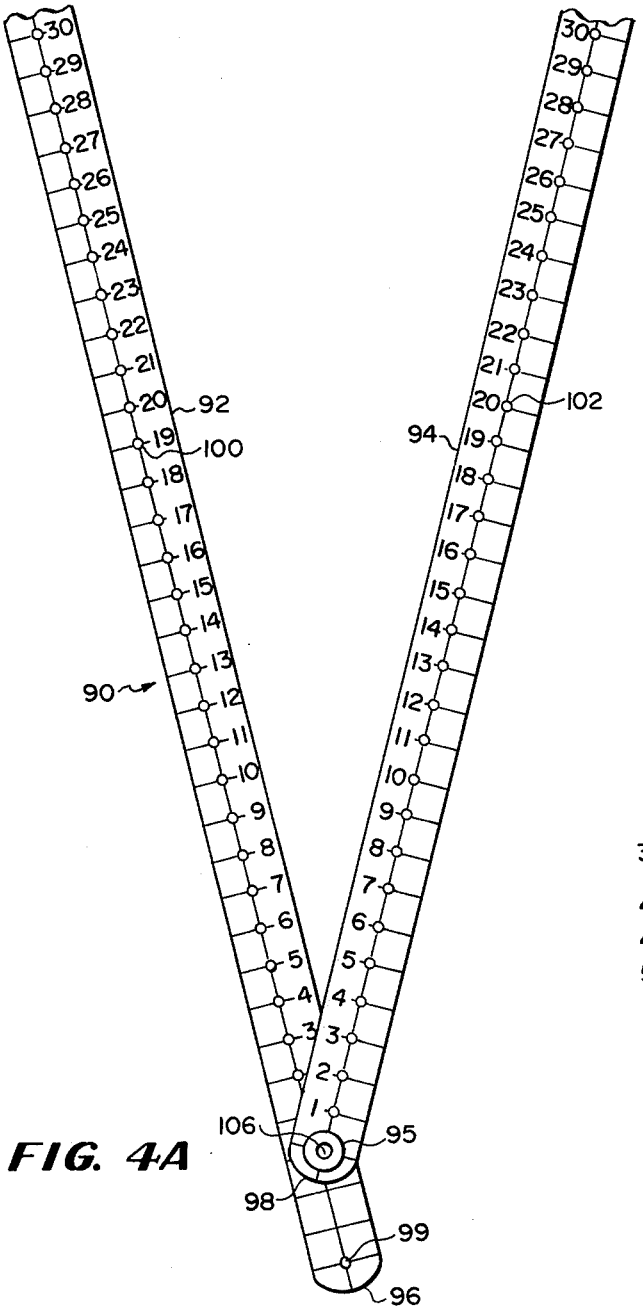
FIGS. 4 and 4A respectively illustrate a pair of layout rules utilized for construction of the graphical display and the curve tracing tool constructed according to the invention.
Figure 4:
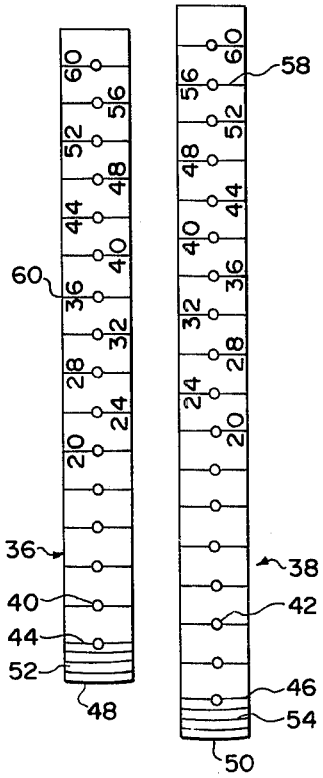

In FIG. 4A, the curve tracer tool 90 is illustrated. Tool 90 consists of two arms, 92 and 94 pivotably secured together as by a snap fastener 95. Each arm is provided with quarter-inch graduations, and a scale numbered consecutively. The scale on arm 92 the lower arm, begins four quarter spaces from one end 96 while the scale on the upper arm 94 begins two quarter spaces from the end 98. Each of the arms 92 and 94 are provided with a row of perforations 100 and 102 respectively, intersecting each of the scale graduations, the perforations being of sufficient diameter to enable passage therethrough of a scribing tool such as a pencil point.

In order to scribe the curvilinear line defining the arms-scye, the operator places one arm 92 over the point at the scale reference equal to the number of spaces plus the allowance for seam and ease. Here, that would be at 14 on arm 92. The other arm 94 is spread or pivoted about its juncture 106 to locate the same scale number (14) over the intersection coincident with the point to be joined, here at point 84. The pivot point 108 would thus be located, and can be secured to sheet 22 on board 24 by a pin 110. A pencil point is then inserted in the perforation 100 coincident with the scale reference point at a scale number 14 and the curve 112 is drawn. A curve 112' shown in broken outline, similarly is drawn by moving the pivot point 108 two spaces allowing for seam with point 84 moved likewise, curve 112' being concentric with curve 112. The same procedure is followed in connecting to form the neck opening. Design changes as to the type of neck opening may be introduced with reference made to the points on the grid, say by numbers of spaces, blocks, and the intersections of the lines defining the blocks. The basic measurements are represented by points along the inside lines, with the standard seam allowances represented by the broken lines two quarter spaces outside the inner lines except along the fold line.

We shall recall that the waist measurement was 28 inches. Therefore, there must be a gathering or reduction of the pattern at the waist. This is accomplished by providing a dart, here represented generally by reference character 114. To provide symmetric points 116 and 118 are located 14 spaces from the fold line and from the ease allowance at the left-hand end of line 72. A point 120 is located four spaces from the intersection of $Y=2$, $X=2$. Lines 122, 124 are scribed connecting points 116 and 120 and 118 and 120. The lines 126 and 128 providing allowance for folding the dart are drawn from 116 and 118 to a point 2 spaces below the X axis (line 34).

Using the curve tracer device 90, the pivot points are self-locating, a procedure not capable of being accomplished using the standard compass, the tool most utilized for curve tracing and development heretofore. The curve tracer likewise can be used to develop the sleeve sloper with the arm measurements found on the respective scales, one scale being used to draw one of the curves and a number one space greater than the measured arm, selected on the second arm and used to draw the other of the curves so as to provide ease allowance. Any width sleeve pattern can be traced with the proper curvature developed.

I claim:

1. A method of making proportionally graded garment pattern component by forming a graphical representation having X and Y axes upon a receptor sheet, said method comprising the steps of: applying a first plurality of equispaced parallel vertical lines and a second plurality of equispaced parallel horizontal lines intersecting said first plurality and upon said receptor sheet to form the graphical representation, determining the spacing of said first plurality along the X axis by measuring around the figure and dividing the measurement so obtained by a factor of 4 to provide a first spacing factor, measuring the center front length of the figure along a line leading from the base of the neck of the figure to the ground and dividing said last-mentioned measurement by a factor of 4 deriving a tentative factor and adding a predetermined factor of 2 to the tentative factor to provide said second spacing factor, the spacing between vertical lines being equal to the first factor and the spacing between horizontal lines being equal to the second factor, marking off a pair of rules with quarter-inch spaced graduations representing the first and second factors and carrying indicia correlating the graduation representing said factors to the measurements from which said factors are derived, marking off said distances along the respective X and Y axes and constructing the graphical representation, and thereafter applying universally applicable pattern layout instructions correlated in terms of said graphical graduations to the specific graphical representation whereby when the universal layout instructions are plotted on the graphical representation for any individual figure, patterned components layed out thereon will be properly proportioned for the said individual figure represented by said graphical representation.

2. The method as claimed in claim 1 in which the distances which are marked off during construction of said graphical representation are marked off by alternately pivoting the rule 180° about points located thereon.

3. The method as claimed in claim 1 and the step of placing curvilinear connecting lines between points on the graphical representation when required using a curve tracer tool which is formed of a pair of pivotally secured arms each carrying a scale marked out in quarter-inch spaces along its length and a row of perforations coincident one with each unit of the scale, directing one of the arms so that a location thereon coincident with one of the other of the dimensions is placed at one of the points to be connected and directing the other of said arms so that a location thereon coincident with the same dimension is positioned at the other of the points to be connected, pivoting one of the arms of the curve tracer tool about a second pivot point located coincident with the juncture of the two arms of the curve tracer tool while placing a scribing instrument through the perforation of said arm at said location thereon and drawing the curve along the arc generated by said pivoting movement.

4. The method as claimed in claim 1 in which the grid is applied to a flexible sheet material affixed to a rigid board member which is capable of receiving pinlike fastening means, the grid being applied to the sheet material using a pair of short rule members carrying quarter-inch divisions in a series beginning one-quarter inch from one end thereof and sixteenth inch divisions between said one end and said beginning.

5. The method as claimed in claim 4 in which the scale applied to one short rule is used to mark off the horizontal spacing between parallel vertical lines while the scale applied to the other short rule is used to mark off vertical spacing between the parallel horizontal lines.

6. The method as claimed in claim 5 in which the base line for use in pivoting the short rules to define said dimensions is selected as one of the sixteenth inch divisions between the said one end and said original base line representing the quotient when same is a fractional number between one and three-sixteenths with the other location being the closest whole number on the scale.

7. The method as claimed in claim 3 in which each of the rules is scaled in quarter-inch space divisions and the scale comprises indicia signifying the actual measurement but located a number of quarter-inch divisions representative of the derived quotients.

* * * * *